US006194114B1

(12) United States Patent
Toyoda et al.

(10) Patent No.: US 6,194,114 B1
(45) **Date of Patent: *Feb. 27, 2001**

(54) HEAT-FIXABLE DEVELOPER FOR ELECTROPHOTOGRAPHY

(75) Inventors: Hideo Toyoda, Iwakuni; Hideki Sakai, Hiroshima; Toshiyuki Tsutsui; Kenichi Morizono, both of Ohtake, all of (JP)

(73) Assignee: Mitsui Chemicals, Inc., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/006,864

(22) Filed: Jan. 14, 1998

(30) Foreign Application Priority Data

Jan. 17, 1997 (JP) ..... 9-6543
Jul. 16, 1997 (JP) ..... 9-190797

(51) Int. Cl.[7] ..... G03G 9/097
(52) U.S. Cl. ..... 430/110; 430/109; 430/111
(58) Field of Search ..... 430/109, 110, 430/111; 526/347

(56) References Cited

U.S. PATENT DOCUMENTS

| | | | | |
|---|---|---|---|---|
| 4,557,991 | * | 12/1985 | Takagiwa et al. | 430/109 |
| 4,917,982 | | 4/1990 | Tomono et al. | 430/99 |
| 4,921,771 | | 5/1990 | Tomono et al. | 430/110 |
| 5,650,254 | * | 7/1997 | Eguchi et al. | 430/110 |

FOREIGN PATENT DOCUMENTS

| | | | | |
|---|---|---|---|---|
| 63-191817 | * | 8/1988 | (JP) | 430/110 |

OTHER PUBLICATIONS

English Abstract of JP 55–1539454A (pub Dec. 1980).

English Abstract of JP 58–59455A (pub Jun. 1982).

Grant, R. et al., ed. Grant & Hackh's Chemical Dictionaty, Fifth Edition, McGraw–Hill Book Company, NY (1987), pp. 557–558.*

Patent & Trademark Office English–Language Translation of JP 63–191817 (pub. Aug. 1988).*

* cited by examiner

*Primary Examiner*—Janis L. Dote
(74) *Attorney, Agent, or Firm*—Birch, Stewart, Kolasch & Birch, LLP

(57) ABSTRACT

A heat-fixable developer for electrophotography comprising a binder resin (A), a colorant (B) and a releasing agent (C), to be used favorably for electrostatic toner, which developer exhibits no offset phenomenon and causes no staining on the carrier, on the photosensitive body and on the heating roller and is superior in the releasing easiness of the heating roller upon the heat-fixing, in the anti-blocking property and in the fixing performance, wherein the releasing agent (C) comprises at least one ethylene/aromatic vinyl compound copolymer selected from the group consisting of copolymer i) and copolymer ii), the copolymer i) being an ethylene/aromatic vinyl compound copolymer obtained by co-polymerizing ethylene and an aromatic vinyl compound in the presence of a metallocene catalyst (D) and the copolymer ii) being an ethylene/aromatic vinyl compound copolymer obtained by a heat-degradation of a copolymer produced by co-polymerizing ethylene and an aromatic vinyl compound in the presence of a metallocene catalyst (D).

8 Claims, No Drawings

HEAT-FIXABLE DEVELOPER FOR ELECTROPHOTOGRAPHY

FIELD OF THE INVENTION

The present invention relates to a heat-fixable developer for electrophotograph to be used favorably as electrostatic toner and, more specifically, to a heat-fixable developer for electrophotograph favorable on using as an electrostatic toner which exhibits no offset phenomenon and causes no staining on the carrier, on the photosensing body and on the heating roller and which is superior in the releasing easiness of the heating roller upon the heat-fixing, in the anti-blocking property and in the fixing performance.

DESCRIPTION OF THE RELATED TECHNIQUES

Electrostatic toner is used in electrostatic photography for developing a latent image of electrostatic charge formed on a photosensitive substrate by light exposure-charging into visible image. The electrostatic toner comprises, as the developer, electrostatically chargeable fine powder of resin containing dispersed therein particulate colorant, such as carbon black or other color pigment. Electrostatic toners are generally classified into dry two-component toner used as a mixture of electrostatically chargeable fine powder such as above with a carrier component, such as iron powder or glass powder; wet toner as a disperse system using an organic solvent, such as isoparaffin or the like; and dry unicomponent toner of the electrostatically chargeable fine powder mentioned above dispersed in a gas phase.

The image obtained by being developed on a photosensitive material using an electrostatic toner is fixed, after the toner image is transferred onto a paper, or directly when the image is obtained by a direct development on a paper having a photosensitive layer, by means of heat or by using vapour of a solvent. In particular, fixing by means of a heating roller brings about advantages, such that the thermal efficiency is high due to contacting fixing and, thus, the image can be fixed even using a heat source of relatively low temperature and that it is adapted for a high speed photocopying.

Due to the growing extension of the application range of electrophtography in recent years, in particular, demand for fixing electrostatic toner image with an energy lower than that used in the prior art becomes increased. For example, reduction of electric power consumption by the heating roller is requested as the incorporation of electrophotography in household devices and instruments progresses. Also a high-speed fixing ability is required for toners for use in output terminals of high-speed devices, such as computers.

When, however, an image is to be fixed by contacting a heating element, such as heating roller, a so-called offset phenomenon may occur, namely, a phnomenon in which a part of the electrostatic toner is held affixed on the heating element and is transferred onto a portion of the subsequent image and developed. In particular, when the temperature of the heating roller is lower, the electrostatic toner will not sufficiently be softened, so that fixing performance on a paper or film becomes deteriorated and the offset phenomenon will be apt to occur. Also, when the heating element is brought to higher temperature for increasing the effect and velocity of the fixing for high speed photocopying, an offset phenomenon may often be caused. Therefore, such a measure as an impregnation of the heating roller surface with a silicone oil or a lubrication of the heating roller surface with a silicone oil supplied thereto, has been incorporated for eliminating the offset phenomenon, which may cause, in reverse, a problem of inducing a staining of the heating roller.

For the binder resin as one of the component of the electrostatic toner, there have been employed various thermoplastic resins, wherein especially a lower molecular weight copolymer of styrene/(meth)acrylate has find its wide use, since it provides many practical advantages such that it attains a better electrostatic chargeability, permits easy fixing due to its proper softening point at aroud 100° C., causes scarce staining of the photosensitive surface with permission of easy cleaning thereof, has a low hygroscopic property, reveals a better miscibility with carbon black as colorant and is easy to be pulverized.

However, the conventional electrostatic toner in which a binding resin of the styrene/(meth)acrylate lower molecular weight copolymer is used has problems, for example, in that it is liable to suffer from easy occurrence of offset phenomenon on fixing by a heating roller of lower temperature or in a high-speed photocopy.

For solving such problems, there was proposed to add a polyolefin wax as releasing agent to the electrostatic toner [Japanese Patent Kokai Nos. 49-65231 A (corresponding to U.S. Pat. No. 4917982), 49-65232 A (corresponding to U.S. Pat. No. 4921771), 50-27546 A, 55-153944 A and 58-59455 A]. However, even the electrostatic toner having addition of polyolefin wax mentioned above does not reveal sufficient fixing performance under the low energy fixing condition of recent years and has not succeeded in preventing occurrence of offset phenomenon.

In addition, another problem may occur, for example, in that the toner with addition of polyolefin wax exhibits a decreased anti-blocking property, so that blocking of the toner may sometimes occur within the toner cartridge to thereby disrupt toner supply to the photosensitive surface.

Moreover, there may occur a so-called filming phenomenon, in which substances with lower crystallizability contained in the polyolefin wax will adhere onto the carrier, photosensitive surface, heating roller and so on, resulting in an adverse effect on the formation of electrostatic latent image on the photosensitive surface and on the electrostatic charge of the toner to thereby deteriorate the quality of the resulting image considerably.

SUMMARY OF THE INVENTION

The object of the present invention is to provide a heat-fixable developer for electrophotography to be used for electrostatic toner which is superior in the ability of releasing from the heating roller, especially in a low energy fixing, together with superiorities in the resistance to blocking of toner and in the fixing without suffering from occurrence of offset phenomenon and from staining on the carrier, photosensitive surface, heating roller and so on and, thus, is favorable as electrostatic toner.

The inventors had been in sound researches for attaining the above-mentioned object and found that the object was able to be attained by using, as a wax to be added to the electrostatic toner, a specific ethylene/ aromatic vinyl compound copolymer obtained by using a metallocene catalyst, which has led to the present invention.

The heat-fixable developer for electrophotography according to the present invention, comprises a binder resin (A), a colorant (B) and a releasing agent (C), wherein the releasing agent (C) comprises at least one ethylene/aromatic vinyl compound copolymers selected from the group consisting of copolymer i) and copolymer ii)

the copolymer i) being an ethylene/aromatic vinyl compound copolymer obtained by co-polymerizing ethylene and an aromatic vinyl compound in the presence of a metallocene catalyst (D) and the copolymer ii) being an ethylene/aromatic vinyl compound copolymer obtained by a heat-degradation of a copolymer produced by co-polymerizing ethylene and an aromatic vinyl compound in the presence of a metallocene catalyst (D).

DETAILED DESCRIPTION OF THE INVENTION

For the component (A), namely, the binder resin of the heat-fixable developer for electrophotography according to the present invention (in the following, sometimes referred to simply as the developer), any resin which permits to preserve the image visualized by the colorant (B) by fixing on a paper or film for long term and which is superior in the electrostatical chargeability, in the fixing performance and in the missibility with the colorant (B) together with a suitable softening point (at around 100° C.) can be used without any special limitation. For such a resin, there may be used, for example, thermoplastic resins conventionally employed for the heat-fixable developer for electrophotography of this kind and other resins having properties comparable thereto.

For the binder resin (A), concretely, there may be enumerated non-crystalline resins, such as for example, polymers based on styrene, ketone resins, maleate resins, aliphatic polyester reins, aromatic polyester resins, cumarone resins, phenol resins, epoxy resins, terpene reins, polyvinyl butyral, poly-butyl methacrylate, polyvinyl chloride and polybutadiene. Such binder resins (A) can be used alone or in a combination of two or more of them. Among the binder resins (A) given above, polymers based on styrene are preferred in view of their favorable softening points at around 100° C. and of their better fixability.

As the polymers based on styrene, there may be enumerated, for example, homopolymers made exclusively of monomers based on styrene and copolymers of monomers based on styrene with other vinyl monomers. As the monomers based on styrene, there may be exemplified styrene, p-chlorostyrene and vinylnaphthalene.

As the above-mentioned other vinyl monomer, there may be enumerated, for example, ethylenically unsaturated monoolefins, such as ethylene, propylene, 1-butene and isobutene; halogenated vinyl compounds, such as vinyl chloride, vinyl bromide and vinyl fluoride; vinyl esters, such as vinyl acetate, vinyl propionate, vinyl benzoate and vinyl acetate; esters of α-methylene aliphatic monocarboxylic acids, such as methyl acrylate, ethyl acrylate, n-butyl acrylate, isobutyl acrylate, n-octyl acrylate, dodecyl acrylate, 2-chloroethyl acrylate, phenyl acrylate, methyl α-chloroacrylate, methyl methacrylate, ethyl methacrylate and butyl methacrylate; nitriles and amides, such as acrylonitrile, methacrylonitrile and acrylamide; vinyl ethers, such as vinyl methyl ether, vinyl ethyl ether, vinyl propyl ether and vinylisobutyl ether; vinylketones, such as vinyl methyl ketone, vinyl hexyl ketone and methyl isopropenyl ketone; and N-vinyl compounds, such as N-vinylpyrrole, N-vinylcarbazole, N-vinylindole and N-vinylpyrrolidone. Among these vinyl monomers, esters of α-methylene aliphatic monocarboxylic acids are preferred.

As the polymers based on styrene, those having a weight-average molecular weight (Mw) of 2,000 or more and, in particular, those having a weight-average molecular weight (Mw) of 3,000–30,000 are preferable. Also for the polymer based on styrene, those having a styrene content of 25% by weight or more are preferable.

For the colorant as the component (B) of the developer according to the present invention, there is no special limitation therefor and any one can be used therefor so long as it does not fade over a long term, so that every colorant employed conventionaly for such heat-fixing developer for electrophotography and similar ones thereto can be used.

Concrete examples of the colorant (B) include pigments and dyes such as carbon black, PHTHALOCYANINE BLUE, ANILINE BLUE, CALCO OIL BLUE, CHROME YELLOW, ULTRAMARINE BLUE, QUINOLINE YELLOW, lamp black, ROSE BENGALE, DIAZO YELLOW, RHODAMINE B LAKE, CARMINE 6B, and derivatives of quinacridone. They may be used either alone or in combination of one or more of them.

To the colorant (B), there may be admixed, for the purpose of supplement of color and for controlling the electrostatic charge, oil-soluble dyes, such as Nigrosines based on azine, Induline, azo dyes, anthraquinone dyes, dyes based on triphenylmethane, xanthene dyes and phthalocyanine dyes.

The ethylene/aromatic vinyl compound copolymer (C) to be used according to the present invention is a copolymer of ethylene and an aromatic vinyl compound obtained by using the metallocene catalyst (D) and is either an ethylene/aromatic vinyl compound copolymer produced by co-polymerizing ethylene and an aromatic compound in the presence of a metallocene catalyst (D) or an ethylene/aromatic vinyl compound copolymer obtained by a heat-degradation of a copolymer of ethylene and an aromatic vinyl compound produced by copolymerization in the presence of a metallocene catalyst (D).

For the aromatic vinyl compound to be copolymerized with ethylene, there may be exemplified styrene, α-methylstyrene, 2-methylstyrene, 3-methylstyrene, 4-methylstyrene, 2,5-dimethylstyrene, 3,4-dimethylestyrene, 2,4,6-trimethylstyrene, 2-ethylstyrene, 3-ethylstyrene, 4-butylstyrene, 4-sec-butylstyrene, 4-tert-butylstyrene, 4-hexylstyrene, 4-nonylstyrene, 4-octylstyrene, 4-phenylstyrene, 4-decylstyrene, 4-dodecylstyrene, 2-chlorostyrene, 3-chlorostyrene, 4-chlorostyrene, 2,4-dichlorostyrene, 3,4-dichlorostyrene, 2-methoxystyrene, 4-methoxystyrene and 4-ethoxystyrene. They may be used either alone or in combination of two or more of them.

The ethylene/aromatic vinyl compound copolymer (C) to be used according to the present invention may preferably be one which contains 85–99 mole %, preferably 95–99 mole % of the structural unit derived from ethylene and 1–15 mole %, preferably 1–5 mole % of the structural unit derived from the aromatic vinyl compound.

The weight-average molecular weight (Mw) of the ethylene/aromatic vinyl compound copolymer (C) may favorably be 500–18,000, preferably 1,000–11,000. In the context of the present invention, the weight-average molecular weight (Mw) is a value which is determined by a gel permeation chromatography (GPC) using a calibration curve prepared preliminarily using a monodisperse polystyrene and is thus a value converted into that of the monodisperse polystyrene.

The melting point of the ethylene/aromatic vinyl compound copolymer (C) may favorably be in the range usually of 60–130° C., preferably 90–120° C.

In the context of the present invention, this melting point is a value determined by a differential scanning calorimeter (DSC).

According to the present invention, it is permissible to use, as the ethylene/aromatic vinyl compound copolymer (C), a graft-modified product of the above-mentioned copolymer of ethylene and an aromatic vinyl compound prepared by subjecting the copolymer to a grafting modification with a modifier, such as an aromatic vinyl compound or a compound of an unsaturated carboxylic acid. The grafted amount of the modifier in the graft-modified product may favorably be in the range of 3–60%, preferably 5–40%, by weight.

For the aromatic vinyl compound as the above-mentioned grafting modifier, those which are the same or similar to the aromatic vinyl compound to be copolymerized with ethylene may be enumerated.

For the compound of unsaturated carboxylic acid to be used as the grafting modifier mentioned above, there may be exemplified acrylates, such as methyl acrylate, ethyl acrylate, butyl acrylate, sec-butyl acrylate, isobutyl acrylate, propyl acrylate, isopropyl acrylate, 2-octyl acrylate, dodecyl acrylate, stearyl acrylate, hexyl acrylate, isohexyl acrylate, phenyl acrylate, 2-chlorophenyl acrylate, dimethylaminoethyl acrylate, 3-methoxybutyl acrylate, acrylic acid diethylene glycol ethoxylate and 2,2,2-trifluoroethyl acrylate; methacrylates, such as methyl methacrylate, ethyl methacrylate, butyl methacrylate, sec-butyl methacrylate, isobutyl methacrylate, propyl methacrylate, isopropyl methacrylate, 2-octyl methacrylate, dodecyl methacrylate, stearyl methacrylate, hexyl methacrylate, decyl methacrylate, phenyl methacrylate, 2-chlorophenyl methacrylate, diethylaminoethyl methacrylate, 2-ethylhexyl methacrylate and 2,2,2-trifluoroethyl methacrylate; maleates, such as ethyl maleate, propyl maleate, butyl maleate, dipropyl maleate and dibutyl maleate; fumarates, such as ethyl fumarate, butyl fumarate and dibutyl fumarate; and itaconates, such as ethyl itaconate, diethyl itaconate and butyl itaconate.

For the modification of the ethylene/aromatic vinyl compound copolymer (C), various known methods can be employed. For example, a method in which the ethylene/aromatic vinyl compound copolymer is reacted with an aromatic vinyl compound or with a compound of an unsaturated carboxylic acid by melt-mixing with heating in the presence of a radical initiator may be employed. The reaction temperature herefor may range preferably from 125 to 325° C. For the radical initiator, there may be used a peroxide, such as benzoyl peroxide, lauroyl peroxide, dicumyl peroxide or di-tert-butyl peroxide, or an azo compound, such as azobisisobutylonitrile.

For producing the ethylene/aromatic vinyl compound copolymer (C) using the metallocene catalyst (D), techniques may be employed in which ethylene and an aromatic vinyl compound are co-polymerized in the presence of a metallocene catalyst (D) and in which a copolymer obtained by co-polymerizing ethylene and an aromatic vinyl compound in the presence of a metallocene catalyst (D) is subjected to a thermal degradation with heating.

The metallocene catalyst (D) and the technique for co-polymerizing ethylene and an aromatic vinyl compound in the presence of the metallocene catalyst (D) will be detailed afterwards.

For the technique of heat-degradation of an ethylene/aromatic compound copolymer obtained from copolymerization using the metallocene catalyst (D), there may be employed, for example, a method in which a high molecular weight copolymer of ethylene/aromatic vinyl compound is supplied to a mono-, bi- or polyaxial extruder and is extruded while melt kneading, a method in which a high molecular weight copolymer of ethylene/ aromatic vinyl compound is supplied directly to a tubular or vessel-form reactor and is heated to cause thermal degradation thereof or a method in which a high molecular weight copolymer of ethylene/aromatic vinyl compound is supplied to an extruder to extrude it continuously into a tubular reactor while melt kneading and is heated to cause thermal degradation thereof. The heating temperature in the extruder or in the reactor is chosen at 300–450° C., preferably at 350–400° C. Among these techniques, the method of supplying the high molecular weight ethylene/aromatic vinyl compound copolymer to an extruder to extrude it continuously into a tubular reactor to subject it to heat-degradation by heating is preferred. The heat-degradation of the copolymer may preferably be carried out in an atmosphere of an inert gas, such as nitrogen.

The ethylene/aromatic vinyl compound copolymer (C) in the developer according to the present invention may be used alone or in combination of two or more of them.

Now, the description is directed to the metallocene catalyst (D).

For the metallocene catalyst (D), those based on metallocene used hitherto as single site catalyst and ones simillar to them may be used without any restriction, wherein, however, special preference is given to catalysts composed of a metallocene (E) of a transition metal (referred to as a transition metal compound), an organic aluminum oxycompound (F) and/or an ionizing ionic compound (G).

For the metallocene (E), those of transition metals selected from Group IVB of the periodic table and, concretely, those expressed by the following general formula (1) may be enumerated.

$$ML_x \quad (1)$$

in which M denotes a metal selected from the Group IVB of the periodic table and, concretely, zirconium, titanium or hafnium, x is the valence of the transition metal.

L represents a ligand coordinating to the transition metal, wherein at least one of the ligands has a cyclopentadienyl skeleton and the ligand L having the cyclopentadienyl skeleton may have substituent group(s).

For the ligand having the cyclopentadienyl skeleton, there may be enumerated, for example, cyclopentadienyl; alkyl- or cycloalkyl-substituted cyclopentadienyl, such as, methylcyclopentadienyl, ethylcyclopentadienyl, n- or i-propylcyclopentadienyl, n-, i-, sec- or tert-butylcyclopentadienyl, hexylcyclopentadienyl, octylcyclopentadienyl, dimethylcyclopentadienyl, trimethylcyclopentadienyl, tetramethylcyclopentadienyl, pentamethylcyclopentadienyl, methylethylcyclopentadienyl, methylpropylcyclopentadienyl, methylbutylcyclopentadienyl, methylhexylcyclopentadienyl, methylbenzylcyclopentadienyl, ethylbutylcyclopentadienyl, ethylhexylcyclopentadienyl and methylcyclohexylcyclopentadienyl; and others, such as indenyl, 4,5,6,7-tetrahydroindenyl and fluorenyl.

These ligand groups may further be substituted by, for example, halogen atom(s) and trialkylsilyl group(s).

Among them, alkyl-substituted cyclopentadienyls are especially preferred.

In the case where the metallocene (E) represented by the formula (1) has two or more ligand groups L having the cyclopentadienyl skeleton, two of these ligand groups having the cyclopentadienyl skeleton may be bound together through a bridging group, for example, an alkylene, such as ethylene or propylene; a substituted alkylene, such as isopropylidene or diphenylmethylene; silylene or a substituted silylene, such as dimethylsilylene, diphenylsilylene or methylphenylsilylene.

For other ligand group L than those having the cyclopentadienyl skeleton, there may be enumerated, for example, hydrocarbon groups, alkoxy groups, aryloxy groups and sulfo-containing groups (—$SO_3R^1$, in which RI denotes an alkyl, a halogen-substituted alkyl, an aryl or a halogen- or alkyl-substituted aryl) having 1–12 carbon atoms, as well as halogen atoms and hydrogen atom.

As the hydrocarbon groups having 1–12 carbon atoms, there may be enumerated such groups as alkyl, cycloalkyl, aryl and aralkyl and, more concretely, alkyl groups, such as methyl, ethyl, n-propyl, isopropyl, n-butyl, isobutyl, sec-butyl, tert-butyl, pentyl, hexyl, octyl, decyl and dodecyl; cycloalkyl groups, such as cyclopentyl and cyclohexyl; aryl groups, such as phenyl and tolyl; and aralkyl groups, such as benzyl and neophyl.

As the alkoxy groups, there may be enumerated, for example, methoxy, ethoxy, n-propoxy, isopropoxy, n-butoxy, isobutoxy, sec-butoxy, tert-butoxy, pentoxy, hexoxy and octoxy.

As the aryloxy group, for example, phenoxy may be enumerated.

As the sulfo-containing groups (—$SO_3R^1$), there may be enumerated, for example, methanesulfonato, p-toluenesulfonato, trifluoromethanesulfonato and p-chlorobenzenesulfonato.

As the halogen atoms, fluorine, chlorine, bromine and iodine are exemplified.

When the transition metal of the metallocene (E) represented by the general formula (1) has a valency of 4, it may be represented more concretely by the general formula (2):

$$R^2_kR^3_1R^4_mR^5_nM \quad (2)$$

In the formula (2), M is a transition metal same as that given in the general formula (1), preferably zirconium or titanium, $R^2$ represents a group (ligand) having a cyclopentadienyl skeleton, $R^3$, $R^4$ and $R^5$ represent each, independently of each other, a group having a cyclopentadienyl skeleton or one which is given in the general formula (1) as the ligand L other than that having a cyclopentadienyl skeleton. k is an integer of l or higher, wherein k+l+m+n=4.

Examples of the metallocene (E) which contains at least two ligands having each a cyclopentadienyl skeleton and in which M is zirconium are given below:

Bis(cyclopentadienyl)zirconium monochloride monohydride,
bis(cyclopentadienyl)zirconium dichloride,
bis(cyclopentadienyl)methylzirconium monochloride,
bis(cyclopentadienyl)zirconium phenoxymonochloride,
bis(methylcyclopentadienyl)zirconium dichloride,
bis(ethylcyclopentadienyl)zirconium dichloride,
bis(n-propylcyclopentadienyl)zirconium dichloride,
bis(isopropylcyclopentadienyl)zirconium dichloride,
bis(cyclopentadienyl)zirconium bis(methanesulfonate),
bis(cyclopentadienyl)zirconium bis(p-toluenesulfonate),
bis(1,3-dimethylcyclopentadienyl)zirconium dichloride,
bis(1-methyl-3-ethylcyclopentadienyl)zirconium dichloride and
bis(1-methyl-3-propylcyclopentadienyl)zirconium dichloride.

According to the present invention, it is also possible to use a metallocene (E) in which the 1,3-substituted cyclopentadienyl as given above is replaced by a corresponding 1,2-substituted cyclopentadienyl.

There may also be exemplified metallocenes (E) of bridged structure in which at least two of the ligands $R^2$, $R^3$, $R^4$ and $R^5$, for example, $R^2$ and $R^3$ are the group having a cyclopentadienyl skeleton and such at least two groups are bound each other through a bridging group, such as alkylene, substituted alkylene, silylene or substituted silylene. In this case, the groups $R^4$ and $R^5$ stand, independently of each other, for the ligand L other than that having a cyclpentadienyl skeleton as given in the general formula (1).

As the metallocene (E) of such a bridged type, there may be enumerated, for example, ethylenebis(indenyl) dimethylzirconium, ethylenebis(indenyl)zirconium dichloride, ethylenebis(indenyl)zirconium-bis (trifluoromethane sulfonate) and isopropylidenebis(indenyl) zirconium dichloride.

According to the present invention, it is preferable to use as the metallocene (E) of bridged type a metallocene represented by the general formula (3):

(3)

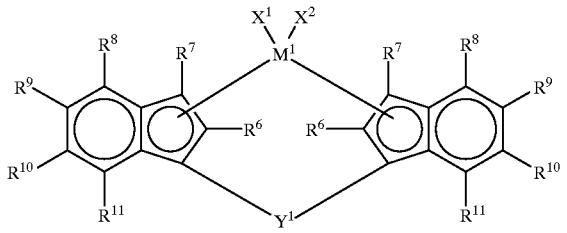

In the formula (3), $M^1$ represents a transition metal of Groups IVB, VB or VIB of the periodic table and is, concretely, titanium, zirconium or hafnium.

$R^6$ and $R^7$ represent each, independently of each other, hydrogen atom, a halogen atom, a hydrocarbon group having 1–20 carbon atoms, a halogenated hydrocarbon group having 1–20 carbon atoms, a silicium-containing group, an oxygen-containing group, a sulfur-containing group, a nitrogen-containing group or a phosphorus-containing group and, concretely, a halogen atom, such as fluorine, chlorine, bromine or iodine; a hydrocarbon group having 1–20 carbon atoms, for example, an alkyl group, such as methyl, ethyl, propyl, butyl, hexyl or cyclohexyl; an alkenyl group, such as vinyl, propenyl or cyclohexenyl; an aralkyl group, such as benzyl, phenylethyl or phenylpropyl; or an aryl group, such as phenyl, tolyl, dimethylphenyl, naphthyl or methylnaphthyl; a halogenated hydrocarbon group in which the hydrocarbon group such as given above is substituted by halogen atom(s); a silicium-containing group, for example, a hydrocarbon-monosubstituted silyl group, such as methylsilyl or phenylsilyl, a hydrocarbon-disubstituted silyl, such as dimethylsilyl or diphenylsilyl, a hydrocarbon-trisubstituted silyl, such as trimethylsilyl or triethylsilyl, a silyl ether of a hydrocarbon-substituted silyl, such as trimethylsilyl ether, a silicium-substituted alkyl group, such as trimethylsilylmethyl, or a silicium-substituted aryl group, such as trimethylsilylphenyl; an oxygen-containing group, for example, hydroxy, alkoxy, such as methoxy or ethoxy, aryloxy, such as phenoxy or methylphenoxy, or arylalkoxy, such as phenylmethoxy or phenylethoxy; a sulfur-containing group in which the oxygen in the above oxygen-containing group is replaced by sulfur; a nitrogen-containing group, for example, amino, alkylamino, such as methylamino or dimethylamino, or an aryl- or alkylarylamino, such as phenylamino or methylphenylamino; or a phosphorus-containing group, such as dimethylphosphino.

Among them, for $R^6$, a hydrocarbon group, in particular, a hydrocarbon group having 1–3 carbon atoms, such as methyl, ethyl or propyl, is preferred. For $R^7$, hydrogen atom or a hydrocarbon group, especially hydrogen atom or a hydrocarbon group having 1–3 carbon atoms, such as methyl, ethyl or propyl is preferred.

$R^8$, $R^9$, $R^{10}$ and $R^{11}$ stand each, independently of each other, for hydrogen atom, a halogen atom, a hydrocarbon group having 1–20 carbon atoms or a halogenated hydrocarbon group having 1–20 carbon atoms. Among them, hydrogen atom, a hydrocarbon and a halogenated hydrocarbon are preferred. Among the pairs of $R^8$ with $R^9$, $R^9$ with $R^{10}$ and $R^{10}$ with $R^{11}$, at least one pair may combine together to build up a monocyclic aromatic ring together with the carbon atoms bound to such a pair.

If two or more hydrocarbon radicals or halogenated hydrocarbon radicals are present in the groups other than that building up an aromatic ring, they may combine together to form a ring. In the case where $R^{11}$ is a substituent group other than an aromatic group, it may represent preferably hydrogen atom.

For the halogen atom, for the hydrocarbon group having 1–20 carbon atoms and for the halogenated hydrocarbon group having 1–20 carbon atoms, there may be enumerated concretely those which are given for $R^6$ and $R^7$.

$X^1$ and $X^2$ in the formula (3) represent each, independently of each other, hydrogen atom, a halogen atom, a hydrocarbon group having 1–20 carbon atoms, a halogenated hydrocarbon group having 1–20 carbon atoms, an oxygen-containing group or a sulfur-containing group.

For the halogen atom, for the hydrocarbon group having 1–20 carbon atoms, for the halogenated hydrocarbon group having 1–20 carbon atoms and for the oxygen-containing group, concretely, those which are given for $R^6$ and $R^7$ may be exemplified.

For the sulfur-containing group, there may be exemplified sulfonates, such as methyl sulfonate, trifluoromethane sulfonate, phenyl sulfonate, benzyl sulfonate, p-toluene sulfonate, trimethylbenzene sulfonate, triisobutylbenzene sulfonate, p-chlorobenzene sulfonate and pentafluorobenzene sulfonate; and sulfinates, such as methyl sulfinate, phenyl sulfinate, benzene sulfinate, p-toluene sulfinate, trimethylbenzene sulfinate and pentafluorobenzene sulfinate, in addition to those which are given for $R^6$ and $R^7$.

$Y^1$ stands for a divalent hydrocarbon radical having 1–20 carbon atoms, a divalent halogenated hydrocarbon radical having 1–20 carbon atoms, a divalent silicium-containing radical, a divalent germanium-containing radical, a divalent tin-containing radical, —O—, —CO—, —S—, —SO—, —$SO_2$—, —$NR^2$—, —$P(R^{12})$ —$P(O)(R^{12})$—, —$BR^{12}$— or —$AlR^2$—, wherein $R^{12}$ represents hydrogen, a halogen atom, a hydrocarbon group having 1–20 carbon atoms or a halogeneted hydrocarbon group having 1–20 carbon atoms.

Concrete examples of $Y^1$ include divalent hydrocarbon groups having 1–20 carbon atoms, for example, alkylenes, such as methylene, dimethylmethylene, 1,2-ethylene, dimethyl-1,2-ethylene, 1,3-trimethylene, 1,4-tetramethylene, 1,2-cyclohexylene and 1,4-cyclohexylene; arylalkylenes, such as diphenylmethylene and diphenyl-1,2-ethylene; halogenated hydrocarbon groups corresponding to halogenated ones of the above divalent hydrocarbon groups having 1–20 carbon atoms, such as chloromethylene; divalent silicium-containing radicals, for example, alkyl silylenes, alkylarylsilylenes and arylsilylenes, such as methylsilylene, dimethylsilylene, diethylsilylene, di(n-propyl)silylene, di(i-propyl)silylene, di(cyclohexyl)silylene, methylphenylsilylene, diphenylsilylene, di(p-tolyl)silylene and di(p-chlorophenyl)silylene, and alkyldisilylenes, alkylaryldisilylenes and aryldisilylenes, such as tetramethyl-1,2-disilylene and tetraphenyl-1,2-disilylene; divalent germanium-containing radicals corresponding to those in which the silicium atom is replaced by germanium in the above divalent silicon-containing radicals; and divalent tin-containing radicals corresponding to those in which the silicium atom is replaced by tin in the above silicium-containing radicals.

The group $R^{12}$ stands for a halogen atom, a hydrocarbon group having 1–20 carbon atoms and a halogenated hydrocarbon group having 1–20 carbon atoms, such as those given for the group $R^6$ or $R^7$.

Among them, divalent silicon-containing radicals, divalent germanium-containing radicals and divalent tin-containing radicals are preferred, wherein special preference is given to divalent silicium-containing radicals and, in particular, to alkylsilylenes, alkylarylsilylenes and arylsilylenes.

Concrete examples of the metallocene (E) represented by the formula (3) are recited below:

rac-ethylene-bis(2-methyl-1-indenyl)zirconium dichloride,
rac-dimethylmethylene-bis(indenyl)zirconium dichloride,
rac-dimethylmethylene-bis(2-methyl-1-indenyl)zirconium dichloride,
rac-diphenylmethylene-bis(2-methyl-1-indenyl)zirconium dichloride,
rac-dimethylsilylene-bis(2-methyl-1-indenyl)zirconium dichloride,
rac-dimethylsilylene-bis(2-methyl-1-indenyl)zirconium-dimethyl,
rac-dimethylsilylene-bis(4,7-dimethyl-1-indenyl)zirconium dichloride,
rac-dimethylsilylene-bis(2,4,7-trimethyl-1-indenyl) zirconium dichloride,
rac-dimethylsilylene-bis(2,4,6-trimethyl-1-indenyl) zirconium dichloride,
rac-dimethylsilylene-bis(4-phenyl-1-indenyl)zirconium dichloride,
rac-dimethylsilylene-bis(2-methyl-4-phenyl-1-indenyl) zirconium dichloride,
rac-dimethylsilylene-bis{2-methyl-4-(α-naphthyl)-1-indenyl}zirconium dichloride,
rac-dimethylsilylene-bis{2-methyl-4-(β-naphthyl)-1-indenyl}zirconium dichloride and
rac-dimethylsilylene-bis{2-methyl-4-(1-anthracenyl)-1-indenyl}zirconium dichloride.

According to the present invention, it is also possible to use metallocenes represented by the general formula (4) given below, as the metallocene (E).

$$LaM^2Z_2 \tag{4}$$

in which $M^2$ is a metal of Group IV or of the lanthanide series of the periodic table, La denotes a derivative of non-localized x-bonding group, which provides the active site of the metal $M^2$ with a captive geometry, and the two Zs represent each, independently of each other, hydrogen atom, a halogen atom, a hydrocarbon group having 20 or less carbon atoms, a silyl group having 20 or less silicium atoms or a germyl group having 20 or less germanium atoms.

Among these metallocenes (b) represented by the formula (4), preference is given to those expressed by the following general formula (4-1):

(4-1)

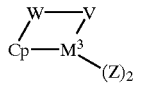

In the formula (4-1), $M^3$ is titanium, zirconium or hafnium, Z is the same as above.

Cp denotes a cyclopentadienyl group, a substituted cyclopentadienyl group or a derivative of these groups, which is bound to $M^3$ by π-bonding in a $\Theta^5$-binding form.

W represents oxygen atom, sulfur atom, boron atom or an element of Group IVA of the periodic table or a radical containing such an element and V is a ligand containing nitrogen, phosphorus, oxygen or sulfur, wherein it is permissible that a condensed ring may be formed from W and V.

Concrete examples of the metallocenes (E) represented by the formula (4-1) include

[dimethyl(t-butylamido)(tetramethyl-$\eta^5$-cyclopentadienyl) silane]titanium dichloride,

[(t-butylamido)tetramethyl-η5-cyclopentadienyl)-1,2-ethanediyl]titanium dichloride,

[dibenzyl(tert-butylamido)(tetramethyl-$\eta^5$-cyclopentadienyl)silane]titanium dichloride,

[dimethyl(tert-butylamido)(tetramethyl-$\eta^5$-cyclopentadienyl)silane]dibenzyltitanium,

[(dimethyl)(tert-butylamido)(tetramethyl-$\eta^5$-cyclopentadienyl)silane]dimethyltitanium.

Alternatively, other metallocenes in which the titanium atom in the above metallocenes (E) is replaced by zirconium or hafnium may also be exemplified.

According to the present invention, the followings may also be used for the metallocene (E):

Ethylene[2-methyl-4(9-phenanthryl)-1-indenyl](9-fluorenyl) zirconium dichloride

Ethylene[2-methyl-4(9-phenanthryl)-1-indenyl](2,7-dimethyl -9-fluorenyl)zirconium dichloride Ethylene[2-methyl-4(9-phenanthryl)-1-indenyl](2,7-di-tert-butyl-9-fluorenyl)zirconium dichloride Ethylene(2-methyl-4,5-benzo-1-indenyl)(9-fluorenyl) zirconium dichloride Ethylene(2-methyl-4,5-benzo-1-indenyl)(2,7-dimethyl-9-fluorenyl)zirconium dichloride Ethylene(2-methyl-4,5-benzo-1-indenyl)(2,7-di-tert-butyl-9-fluorenyl)zirconium dichloride Ethylene(2-methyl-α-acenaphtho-1-indenyl)(9-fluorenyl) zirconium dichloride Ethylene(2-methyl-α-acenaphtho-1-indenyl)(2,7-dimethyl-9 -fluorenyl)zirconium dichloride Ethylene(2-methyl-α-acenaphtho-1-indenyl)(2,7-di-t-butyl-9-fluorenyl)zirconium dichloride Dimethylsilylene[2-methyl-4(9-phenanthryl)-1-indenyl](9-fluorenyl)zirconium dichloride Alternatively, those in which zirconium in the above-exemplified zirconium compounds is replaced by titanium or by hafnium may also be exemplified.

According to the present invention, the metallocene (E) may be used either alone or in combination of two or more of them.

According to the present invention, the metallocenes (E) may be used under dilution in a hydrocarbon or in a halogenated hydrocarbon.

Now, the description is directed to the organic aluminum oxy-compound (F) and to the ionizing ionic compound (G) to be used for preparing the metallocene catalyst (D).

The organic aluminum oxy-compound (F) to be used according to the present invention may be an aluminoxane known in the past or a benzene-insoluble organic aluminum oxy-compound which is exemplified in Japanese Patent Kokai Hei-2-78687 A (corresponding to U.S. Pat. No. 4,990,640).

Such a known aluminoxane (F) is represented, concretely, by the following general formula (5) or (6):

(5)

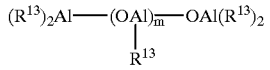

(6)

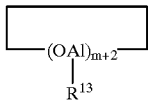

In the above formulae (5) and (6), $R^{13}$ is a hydrocarbon group, such as methyl, ethyl, propyl or butyl, wherein preference is given for methyl and ethyl, especially for methyl, and m is an integer of 2 or greater, preferably of 5–40.

Here, it is also possible that the aluminoxane (F) be composed of mixed alkyloxyaluminum units composed of an alkyloxyaluminum unit represented by the formula [OAl($R^{14}$)] and of an alkyloxyaluminum unit represented by the formula [OAl($R^{15}$)], wherein $R^{14}$ and $R^{15}$ are each a hydrocarbon group same as that given for $R^{13}$ and $R^{14}$ and $R^{15}$ are different from each other.

As the solvent used in the preparation of the aluminoxane (F), there may be exemplified aromatic hydrocarbons, such as benzene, toluene, xylene, cumene and cymene; aliphatic hydrocarbons, such as pentane, hexane, heptane, octane, decane, dodecane, hexadecane and octadecane; alicyclic hydrocarbons, such as cyclopentane, cyclohexane, cyclooctane and methylcyclopentane; ethers, such as ethyl ether and tetrahydrofuran; petroleum cut fractions, such as gasoline, kerosene and gas oil; and halogenated hydrocarbons, such as the chlorinated or brominated products of the hydrocarbons given above. Among these solvents, especially aromatic hydrocarbons are preferred.

For the ionizing ionic compound (G), there may be exemplified Lewis acids, ionic compounds, boranes and carboranes. Such ionizing ionic compounds (G) are given in the literatures, for example, Japanese Patent Kohyo Hei-1-501950 (corresponding to U.S. Pat. Nos. 5,198,401, 5,278,119, 5,384,299, 5,391,629, 5,407,884, 5,408,017, 5,470,927, 5,483,014, 5,599,761 and 5,621,126), Japanese Patent Kohyo Hei-1-502036, (corresponding to U.S. Pat. Nos. 5,153,157, 5,198,401, 5,241,025, 5,384,299, 5,391,629, 5,408,017, 5,470,927, 5,599,761 and 5,621,126), Japanese Patent Kokais Hei-3-179005 (corresponding to U.S. Pat. No. 5,561,092), Hei-3-179006 (corresponding to U.S. Pat. No. 5,225,500), Hei-3-207703 (corresponding to U.S. Pat. No. 5,387,568), Hei-3-207704 (corresponding to U.S. Pat. Nos. 5,519,100, and 5,614,457) and U.S. Pat. No. 5,321,106.

Examples of the Lewis acid to be used as the ionizing ionic compound (G) include compounds expressed by the formula $BR_3$ (R may be identical with or different from each other and may stand for fluorine or a phenyl group which may have substituent group(s), such as fluorine, methyl and trifluoromethyl), for example, trifluoroboron, triphenylboron, tris(4-fluorophenyl)boron, tris(3,5-difluorophenyl)boron, tris(4-fluoromethylphenyl)boron and tris(pentafluorophenyl)boron.

The ionic compound to be uaed as the ionizing ionic compound (G) is a salt composed of a cationic component and an anionic component. The anion functions to stabilize the transition metal of the metallocene by cationizing the metallocene (E) and building up an ion pair when reacted with the metallocene (E). For such an anion, anions of organoboron, organoarsene and organoaluminum are enumerated, wherein an anion of relatively bulky geometry permitting stabilization of transition metal is preferred. For the cation, metal cations, organometallic cations, carbonium cations, oxonium cations, sulfonium cations, phosphonium cations and ammonium cation are enumerated. More specifically, triphenylcarbenium cation, tributylammonium cation, N,N-dimethylammonium cation and ferrocenium cations are preferred.

Among them, ionic compounds having boron-containing moiety as anion are preferred. Concretely, trialkyl-substituted ammonium salts, N,N-dialkylanilinium salts, dialkylammonium salts and triarylphosphonium salts are exemplified for the ionic compound.

As the trialkyl-substituted ammonium salt, Anthere may be enumerated, for example, triethylammonium tetra (phenyl)borate, tripropylammonium tetra(phenyl)borate, tri (n-butyl)ammonium tetra(phenyl)borate and trimethylammonium tetra(p-tolyl)borate.

As the N,N-dialkylanilinium salt, there may be enumerated, for example, N,N-dimethylanilinium tetra (phenyl)borate.

As the dialkylammonium salt, there may be enumerated, for example, di(n-propyl)ammonium tetra (pentafluorophenyl)barate and dicyclohexylammonium tetra (phenyl)borate.

As the triarylphosphonium salt, there may be enuemrated, for example, triphenylphosphonium tetra(phenyl)borate, tri (methylphenyl)phosphonium tetra(phenyl)borate and tri (dimethylphenyl)phosphonium tetra(phenyl)borate.

As the ionic compound, there may further be enumerated triphenylcarbenium tetrakis(pentafluorophenyl)borate, N,N-dimethylanilinium tetrakis(pentafluorophenyl)borate and ferrocenium tetra(pentafluorophenyl)borate.

As the borane compound to be used as the ionizing ionic compound (G), the following compounds may also be enumerated:

Decaborane(14)

Salts of such anion as bis[tri(n-butyl)ammonium] nonaborate and bis[tri(n-butyl)ammonium]decaborate Salts of metal borane anions, such as tri(n-butyl) ammonium bis(dodecahydridododecaborate)cobaltate(III) and bis[tri(n-butyl)ammonium]bis (dodecahydridododecaborate)nickelate(III).

As the carboranes to be used as the ionizing ionic compound (G), there may be enumerated, for example, salts of such anions as 4-carbnonaborane(14) and 1,3-dicarbnonaborane(13); and salts of metal carborane anions, such as tri(n-butyl)ammonium bis(nonahydrido-1,3-dicarbnonaborate)cobaltate(III) and tri(n-butyl)ammonium bis(undecahydrido-7,8-dicarbundecaborate) ferrate(III).

The ionizing ionic compounds (G) such as above may be used alone or in a combination of two or more of them.

The metallocene catalyst (D) to be used according to the present invention may contain on requirement, in addition to the components given above, a further component (H) of an organoaluminum compound given below.

As the organoaluminum compound (H) to be used on requirement according to the present invention, for example, the organoaluminum compounds represented by the following general formula (7) may be enumerated.

$$(R^{16})_nAlX_{3-n} \quad (7)$$

In the formula (7), $R^{16}$ is a hydrocarbon group having 1–15 carbon atoms, preferably 1–4 carbon atoms, X denotes a halogen atom or hydrogen atom and n is an integer of 1–3.

The hydrocarbon group having 1–15 carbon atoms may be, for example, alkyl, cycloalkyl or aryl and, concretely, methyl, ethyl, n-propyl, isopropyl or isobutyl.

Concrete examples of such an organoaluminum compound include the followings:

Trialkylaluminums, such as trimethylaluminum, triethyl aluminum, triisopropylaluminum, tri-n-butyl-aluminum, tri-isobutylaluminum and tri-sec-butylaluminum; alkenylaluminums, such as those represented by the general formula $(i\text{-}C_4H_9)_xAl,(C_5H_{10})_z$, in which x, y and z denote each a positive integer wherein $z \geqq 2x$, for example, isoprenylaluminum; dialkylaluminum halides, such as dimethylaluminum chloride and diisobutylaluminum chloride; dialkylaluminum hydrides, such as diisobutylaluminum hydride and so on; dialkylaluminum alkoxides, such as dimethylaluminum methoxide and so on; and dialkylaluminum aryloxides, such as diethylaluminum phenoxide and so on.

It is permissible to use, as the organoaluminum compound (H), also the compounds represented by the following formula (8):

$$(R^{18})_nAl(R^{17})_{3-n} \quad (8)$$

in which $R^{18}$ has the same meaning as foregoing $R^{16}$, $R^{17}$ is a group of $—OR^{19}$, $—OSi(R^{20})_3$, $—OAl(R^{21})_2$, $—N(R^{22})_2$, $—Si(R^{23})_3$ or $—N(R^{24})Al(R^{25})_2$ and n is a mumber of 1–2, wherein $R^{19}$, $R^{20}$, $R^{21}$ and $R^{25}$ denote each methyl, ethyl, isopropyl, isobutyl, cyclohexyl or phenyl, $R^{22}$ denotes hydrogen atom, methyl, ethyl, isopropyl, phenyl or trimethylsilyl and $R^{23}$ and $R^{24}$ represent each methyl or ethyl.

The followings are concrete examples of such an organoaluminum compound (H):

$(C_2H_5)_2Al[OSi(CH_3)_3]$ $(iso\text{-}C_4H_9)_2Al[OSi(CH_3)_3]$ $(C_2H_5)_2Al[OAl(C_2H_5)_2]$ $(CH_3)_2Al[N(C_2H_5)_2]$ $(C_2H_5)_2Al[NH(CH_3)]$ $(iso\text{-}C_4H_9)_2Al[N\{Si(CH_3)_3\}_2]$ The metallocene catalyst (D) to be used according to the present invention may be a solid catalyst having at least one of the above-mentioned components (E), (F), (G) and (H) supported on a fine particulate carrier.

The metallocene catalyst (D) may also be a prepolymer-catalyst composed of a fine particulate carrier, the component (E) and the component (F) [or the component (G)] and a polymer or a copolymer produced by a preliminary polymerization, with, if necessary, possible incorporation of the component (H).

The fine particulate carrier to be used in the solid catalyst or in the prepolymer-catalyst may be a granular or a fine particulate solid of an organic or inorganic compound having a particle size of 10–300 $\mu$m, preferably 20–200 $\mu$m.

For the inorganic carrier, porous oxides are preferred, of which concrete examples include $SiO_2$, $Al_2O_3$, MgO, $ZrO_2$, $TiO_2$, $B_2O_3$, CaO, ZnO, BaO and $ThO_2$ as well as mixtures of them, such as $SiO_2/MgO$, $SiO_2/Al_2O_3$, $SiO_2/TiO_2$, $SiO_2/V_2O_5$, $SiO_2/Cr_2O_3$ and $SiO_2/TiO_2/MgO$. Among them, those in which at least one selected from the group consisting of $SiO_2$ and $Al_2O_3$ is the principal constituent are preferred.

The inorganic carrier may contain a small amount of one or more of carbonate, sulfate, nitrate or other oxide, such as $Na_2CO_3$, $K_2CO_3$, $CaCO_3$, $MgCO_3$, $Na_2SO_4$, $Al_2(SO_4)_3$, $BaSO_4$, $KNO_3$, $Mg(NO_3)z$, $Al(NO_3)_3$, $Na_2O$, $K_2O$ and $Li_2O$.

While the properties of the fine particulate carrier may be variable for each specific carrier and in accordance with the method of preparation thereof, those which have a specific surface area of 50–1,000 $m^2/g$, preferably 100–700 $m^2/g$ and a pore volume of 0.3–2.5 $cm^3/g$ are preferred. The fine particulate carrier may , if necessary, be calcined at a temperature of 100–1,000° C., preferably 150–700° C. for practical use.

For the fine particulate carrier, there may further be enumerated granular or fine particulate solid materials of organic compounds having particle sizes in the range of 10–300 $\mu$m. Such organic fine particulate carriers may be, for example, homo- and copolymer resins constituted mainly of an $\alpha$-olefin having 2–14 carbon atoms, such as ethylene, propylene, 1-butene or 4-methyl-1-pentene, and homo- and copolymer resins constituted mainly of vinylcyclohexane and/or styrene.

For producing the ethylene/aromatic vinyl compound copolymer (C) using the metallocene catalyst (D), ethylene and an aromatic vinyl compound are subjected to copolymerization usually in a liquid phase in the presence of the metallocene catalyst (D). Here, a hydrocarbon solvent is used in general, while it is possible to use an $\alpha$-olefin, such as propylene, as the solvent.

For such a hydrocarbon solvents, for example, aliphatic hydrocarbons, such as pentane, hexane, heptane, octane, decane, dodecane and kerosene, as well as their halogenated derivatives; alicyclic hydrocarbons, such as cyclohexane, methylcyclopentane and methylcyclohexane, as well as their halogenated derivatives; and aromatic hydrocarbons and their halogenated derivatives, such as benzene, toluene, xylene, ethylbenzene and chlorobenzene, may be employed solely or in a combination.

It is possible that ethylene and the aromatic vinyl compound may be subjected to copolymerization in any practical way, such as batchwise or continuous process. For a continuous process, the metallocene catalyst (D) may be used usually at a concentration as explained below.

Thus, the concentration of the metallocene (E) in the polymerization system may usually be 0.00005–0.1 mmol/liter (of the polymerization volume), preferably 0.0001–0.05 mmol/liter.

The organic aluminum oxy-compound (F) may be supplied in an amount of 1–10000, preferably 10–5000 as the atomic ratio of the metallocene to aluminum (Al/transition metal) in the polymerization system.

The ionizing ionic compound (G) may be supplied to the polymerization system in an amount of 0.5–20, preferably 1–10 as the mole ratio of the ionizing ionic compound (G) to the metallocene (E) [ionizing ionic compound (G)/metallocene (E)].

The organoaluminum compound (H) may, when used, be supplied to the polymerization system usually in an amount of 0–5 mmol/liter (of the polymerization volume), preferably 0–2 mmol/liter.

The copolymerization for producing the ethylene/ aromatic vinyl compound copolymer may be realized usually under the conditions of a temperature of −20 to +150° C., preferably 0 to +120° C., more preferably 0–100° C. and a pressure exceeding the normal pressure and up to 80 $Kg/cm^2$ (gauge), preferably up to 50 $Kg/cm^2$ (gauge).

The polymerization duration (the average residence time in the polymerization reactor for continuous process) may usually be in the range from 5 minutes to 5 hours, preferably from 10 minutes to 3 hours, though variable depending on the conditions, such as catalyst concentration and polymerization temperature.

In the production of the ethylene/aromatic vinyl compound copolymer (C), ethylene and the aromatic vinyl compound are supplied to the polymerization system each in such an amount that a copolymer having a specific composition as given above is obtained. It is permissible to incorporate in the copolymerization a molecular weight regulator, such as hydrogen.

By copolymerizing ethylene and an aromatic vinyl compound as above, the ethylene/aromatic vinyl compound copolymer (C) is obtained usually in a form of a polymerization liquor containing it. This polymerization liquor is treated in a usual manner, whereby the ethylene/aromatic vinyl compound copolymer (C) is isolated.

The ethylene/aromatic vinyl compound copolymer (C) produced using the metallocene catalyst (D) or the ethylene/aromatic vinyl compound copolymer (C) obtained by heat-degradation as described above has the following features:

1) The copolymer serves for a polyethylene wax exhibiting reduced crystallinity due to the at random introduction of the aromatic vinyl compound units, such as styrene units, into the polyethylene backbone chain.
2) The affinity of the copolymer with the binder resin (A) is increased due to the finely dispersed distribution of styrene units over the molecule.

Thus, a heat-fixable developer for exclusive use for electrophotography can be obtained by the incorporation of the ethylene/aromatic vinyl compound copolymer (C) having the above-mentioned features, which is superior in the releasing ability, especially for a low energy heat-f izing, together with excellency in the anti-blocking property and in the fixing ability without suffering from offset phenomenon and staining of the carrier, photosensitive surface and heating roller.

The blending proportion of the binder resin (A), the colorant (B) and the ethylene/aromatic vinyl compound copolymer (C) in the developer according to the present invention in terms of weight proportion of (A)/(B)/(C) may, in general, be in the range in the order of 100/(1–20)/(1–20), preferably 100/(1–10)/ (1–10).

The developer according to the present invention may further contain, in addition to the essential components consisting of the binder resin (A), the colorant (B) and the ethylene/aromatic vinyl compound copolymer (C), other component(s) in an amount not deteriorating the inventive effect. For example, there may be incorporated therein static charge controller, plasicizer and other releasing wax in an appropriate proportion.

The developer according to the present invention can serve both for two-component electrostatic toner and for unicomponent electrostatic toner.

In the case of using the developer as a two-component toner, such a binary toner may be produced, for example, in such a manner that the binder resin (A), the colorant (B), the ethylene/aromatic vinyl compound copolymer (C) and, optionally, other component(s) are mixed by melt kneading on Banbury's mixer or by a known technique using, for example, ball mill, attritor or the like with subsequent kneading on a heating double roller, heating kneader or extruder before solidifying the molten mix by cooling. The resulting solidified mix is then pulverized finely on a jet mill, vibration mill or on a ball mill or attritor with addition of water, after a rough crushing on a hammer mill, crusher or the like or without subjecting rough crushing, into a powder having an average particle size in the range of 5 to 35 $\mu$m, before final blending with a carrier powder into a binary toner. As the carrier powder, known ones, for example, silica sand, glass beads, iron sphere and powder of a magnetic material, such as iron, nickel or cobalt, of a particle size of 200–700 μm may be employed without any special limitation.

The proportion of the ethylene/aromatic vinyl compound copolymer (C) in the binary electrostatic toner is chosen in the range of 1–20 parts by weight, preferably 2–10 parts by weight, per 100 parts by weight of the thermoplastic resin inclusive of the binder resin (A).

In the case of using the developer according to the present invention as a unicomponent electrostatic toner, the toner may be prepared by treating a mixture of the binder resin (A), the colorant (B), the ethylene/aromatic vinyl compound copolymer (C) and, optionally, other component(s), such as other thermoplastic resin, powdery magnetic substance and so on, in the same manner as given above for the binary toner, without addition of carrier powder.

The proportion of the ethylene/aromatic vinyl compound copolymer (C) in this unicomponent toner is chosen in the range of 1–20 parts by weight, preferably 1–10 parts by weight, per 100 parts by weight of the binder resin (A).

For the powdery magnetic substance to be incorporated in the unicomponent electrostatic toner, usually fine magnetite powder is employed, though powders of metals, such as cobalt, iron and nickel as well as alloys of them, oxides of them and ferrite as well as mixtures of them may also be employed. The proportion of the powdery magnetic substance to be incorporated in the unicomponent toner may be such that the electric resistance of the resulting electrostatic toner will not be decreased, while permitting to maintain a better preservativity of the electrostatic charge, to exclude blur of the developed image, to realize a favorable heat fixing performance due to the proper melting temperature of the binder resin and to attain a requisite value of the electrostatic charge with better prevention of toner scattering around the internal spaces, and may usually be in the range of 40–120 parts by weight of the powdery magnetic substance per 100 parts by weight of the total of the binder resin plus the powdery magnetic substance. The binary and the unicomponent electrostatic toners may contain, if necessary, a known static charge regulating agent.

The ethylene/aromatic vinyl compound copolymer (C) according to the present invention can be used also for a component of the so-called polymerizing toner, since it can be converted easily into an aqueous suspension of fine particles by itself or by admixing thereto an emulsifying agent, such as a surfactant.

As described above, the heat-fixable developer for electrophotography according to the present invention comprises a binder resin (A), a colorant (B) and an ethylene/aromatic vinyl compound copolymer of specific ones, so that it is superior in the releasing ability for releasing the heating roller from the developed image especially upon a low energy heat fixing, in the anti-blocking property and in the heat-fixability and does not suffer from occurrence of the so-called offset phenomenon with simultaneous exclusion of staining of the internal surfaces of the electrophotographic machine, such as carrier, photosensitive body, heating roller and so on. Thus, the heat-fixable developer for electrophotography according to the present invention can serve favorably for electrostatic toner.

THE BEST MODE FOR EMBODYING THE INVENTION

Below, the present invention will further be described in more detail by way of Examples, wherein it is to be noted that these Examples should not be regarded as restricting the present invention.

In the Examples, the determination of the weight-average molecular weight (Mw) and the melting point of resin, as well as the evaluation of the fixing performance of the binary electrostatic toner, anti-blocking property, occurrence of offset phenomenon, disturbance of the developed image and pollution on the photosensitive surface and on the heating roller in the assessment of toner performance were realized in accordance with the procedures given below:

<<Weight-Average Molecular Weight>>

A sample of a solution of the ethylene/aromatic vinyl compound copolymer in o-dichlorobenzene of a concentration of 0.1% by weight was prepared. This solution was passed through a column made by connecting GMH-HT (60 cm) with GMH-HTL (60 cm) (both of Toso K.K.) in a gel permeation chromatography apparatus (GPC 150° C. of Waters) at a temperature of 140° C. at a flow rate of 1.0 ml/min. The weight-average molecular weight (Mw) was determined by refering to a calibration curve prepared preliminarily using standard monodisperse polystyrene solutions.

<<Melting Point>>Determination was made using a differential scanning calorimeter (DSC) at a temperature elevation rate of 10° C./min.

>>Heat-Fixability of Developed Image>>

An electrophotographic reproduction of a test image on a selenium photosensitive body and development of the resulting image using a binary electrostatic toner were performed. The resulting developed image was transferred onto a transfer paper and the transferred image was fixed between a fixing roller furnished on its surface with a layer of polytetrafluoroethylene (of DuPont) and an impression roller furnished on its surface with a layer of silicone rubber (KE-130ORTV of Shin-Etsu Chemical Co.) at a fixing roller temperature adjusted at 200° C. Then, the surface of the resulting fixed image was rubbed with an eraser rubber containing sand and having a bottom face of 15 mm×7.5 mm five times under a pressure loaded by a 500 g weight placed thereon. The optical density was determined by the light reflected from the image surface using a reflected light densitometer of MacBeth, whereupon the "image remaining rate" was calculated as a parameter of heat-fixability of the developed image by the following calculation equation:

$$[\text{Image remaining rate } (\%)] = \frac{[\text{Optical density after rubbing}]}{[\text{Optical density before rubbing}]} \times 100$$

<<Anti-Blocking Property of Toner>>

100 g of a binary electrostatic toner were charged in a 500 ml polyethylene bottle and the bottle was shaked for 30 minutes, before the bottle contents was stood still at 60° C. for 50 hours. The resulting toner was cooled to room temperature and examined for occurrence of blocking in the bottle. The degree of occurrence of blocking of the toner was evaluated visually by the following criterion:

◎ No blocking occurred.

○ A blocking that can be destroyed easily by a finger touch was recognized at some places.

Δ A blocking that can be destroyed by a finger touch was recognized at considerable places.

× Many lumps that cannot be crushed easily by finger are formed.

<<Staining on Photosensitive Body and Fixing Roller>>

A test image was reproduced by electrophotography on a selenium photosensitive body and was developed using a binary electrostatic toner. The so-developed image was transferred onto a transfer paper and the transferred image was fixed between a fixing roller of a temperature of 200° C.

furnished on its surface with a layer of polytetrafluoroethylene (of DuPont) and an impression roller furnished on its surface with a layer of silicone rubber (KE-130ORTV of Shin-Etsu Chemical Co., Ltd.). This photoreproduction procedure was repeated 5,000 times, whereupon staining of surfaces of the photosensitive body and fixing roller was detected and estimated visually by the following criteria:

For staining on surfaces of phorosensitive body etc.:

⊙ No staining occured.

○ Only very slight staining on the surface of photosensitive body or fixing roller was recognized.

Δ A little staining on the surface of photosensitive body or fixing roller was recognized.

× Considerable staining on the surface of photo-sensitive body or fixing roller was seen.

EXAMPLE 1

<<Production of Ethylene/Aromatic Vinyl Compound Copolymer (C)>>

1) Preparation of Catalyst Solution

In a glass flask replaced sufficiently with nitrogen gas, 40.5 mg of [dimethyl(tert-butylamido)(tetramethyl-$\eta^5$-cyclopentadienyl)silane]titanium dichroride as the metallocene (E) were placed, whereto 50 ml of a toluene solution of methylaluminoxane (prepared by drying a methylaluminoxane product of Witco into dry solid and redissolving this dried product in toluene; Al concentration=1.1 mole/liter) were added as organic aluminum oxy-compound (F) to obtain the catalyst solution.

2) Polymerization

A one liter glass autoclave displaced by nitrogen gas sufficiently was charged with 498 ml of toluene and 2 ml of styrene and the internal temperature of the autoclave was elevated to 40° C. Subsequently, 30 ml of a catalyst solution prepared as in above 1) (0.06 mmol as titanium) was added thereto while passing a gas mixture of ethylene and hydrogen (at a rate of 100 liters per hour and 4 liters per hour, respectively) thereto to initiate polymerization. Then, the polymerization was conducted at 40° C. under normal pressure for 75 minutes by supplying only ethylene continuously thereto. After the polymerization was terminated by supplying a small amount of ethanol to the reaction system, the unreacted ethylene was purged out. The polymer was recovered by introducing the resulting polymer solution into a large excess of a mixed solution of hydrochloric acid/methanol and the separated polymer was dried overnight at 100° C. under a reduced pressure.

29.5 g of an ethylene/styrene copolymer having a weight-average molecular weight (Mw) of 3,000 with a content of the structural unit of ethylene of 99 mole % and a content of the structural unit of styrene of 1 mole % were obtained. The ethylene/styrene copolymer wax was examined for the weight-average molecular weight (Mw) and for the melting point. Results are summarized in Table 1.

About 50 mg of the so-obtained ethylene/styrene copolymer were dissolved homogeneously in 0.5 ml of hexachlorobutadiene in a test tube and thereto were added 0,05 ml of deuterated benzene to prepare a sample solution for $^{13}$C-NMR spectrometry, with which a $^{13}$C-NMR spectrum was obtained at an observation temperature of 120° C., an observation frequency of 67.8 MHz, 45° C. pulse and 15,000 scans. No peak due to styrene-to-styrene chain block (40–44.7 ppm) was recognized.

<<Preparation of Toner>>

100 parts by weight of a styrene/n-butyl acrylate copolymer [HIMER SEM-73F (trademark), Sanyo CHemical Ind., Ltd.], 4 parts by weight of the ethylene/styrene copolymer otained above, 9 parts by weight of carbon black [DIABLACK SH (trademark), Mitsubishi Chemical Ind. Ltd.], 2 parts by weight of an alloy dyestuff [ZABONFIRSTBLACK B (trademark), BASF] and 2 parts by weight of static charge regulator [P-51 (trademark), Orient Chemical Ind. Ltd.] were mixed by melt-kneading on Banbury's mixer and the melt was then cooled to solidify and the resulting solid was crushed on a jet mill, whereby toner particles having an average particle size of 10–15 μm were obtained after sifting.

<<Carrier Particles>>

A particulate ferrite carrier having an average particle size of 50–80 μm was employed.

<<Preparation of Developer>>

120 parts by weight of the toner particles obtained above and 100 parts by weight of the ferrite carrier particles were mixed to obtain a binary electrostatic developer. This binary developer was tested for the heat-fixability of developed image, anti-blocking property of toner, offset phenomenon, image disturbance and staining on the photosensitive body and fixing roller by the evaluation procedures described above. Results are summarized in Table 1.

EXAMPLES 2 AND 3

Developers were prepared in the same manner as in Example 1 except that the ethylene/styrene copolymer waxes as given in Table 1 were employed instead of the ethylene/styrene copolymer wax of Example 1, whereupon the evaluation of the developers were carried out as in Example 1. The results are summarized also in Table 1.

EXAMPLE 4

An ethylene/styrene copolymer wax was synthesized in the same manner as in Example 1 except that isopropylidene-bis(indenyl)zirconium dichloride ii synthesized by a known method was used as the catalyst, whereupon the preparation of developer and its evaluation were carried out in the same manner as in Example 1. The results are also summarized in Table 1.

| | Examples | | | |
|---|---|---|---|---|
| Material Properties | 1 | 2 | 3 | 4 |
| Copolymer Wax | | | | |
| Weight-average M.W. | 3,000 | 3,000 | 3,000 | 3,000 |
| Styrene cont. (Mol %) | 1 | 3 | 5 | 4 |
| Melting Point (° C.) | 120 | 105 | 93 | 101 |
| Toner | | | | |
| Heat Fixability (%) | 87 | 75 | 73 | 74 |
| Anti-blocking property | ○ | ⊙ | ○ | ⊙ |
| Staining on photosens. body and fix roller | ⊙ | ⊙ | ○ | ⊙ |

What is claimed is:

1. A heat-fixable developer for electrophotography, comprising a binder resin (A), a colorant (B) and a releasing agent (C), wherein the releasing agent (C) comprises at least one ethylene/aromatic vinyl compound random copolymer revealing no peak in the $^{13}$C-NMR spectrum due to aromatic vinyl compound-to-aromatic vinyl compound chain block, wherein the copolymer is selected from the group consisting of copolymer i) and copolymer ii), the copolymer i) being an ethylene/aromatic vinyl compound copolymer obtained by co-polymerizing ethylene and an aromatic vinyl compound in the presence of a metallocene catalyst (D) and the copolymer ii) being an ethylene/aromatic vinyl compound copolymer obtained by a heat-degradation of a copolymer produced by co-polymerizing ethylene and an aromatic vinyl compound in the presence of a metallocene catalyst (D).

2. The heat-fixable developer according to claim 1, wherein the ethylene/aromatic vinyl compound copolymer to be used as the releasing agent (C) comprises 85–99 mole % of the structural unit derived from ethylene and 1–15 mole % of the structural unit derived from the aromatic vinyl compound.

3. The heat-fixable developer according to claim 1, wherein the ethylene/aromatic vinyl compound copolymer has a weight-average molecular weight (MW) of 500–18,000.

4. The heat-fixable developer according to claim 1, wherein the binder resin (A) is one or more non-crystalline resins comprising homopolymers formed from monomers selected from the group consisting of styrene, p-chlorostyrene and vinylnaphthalene or copolymers formed from monomers selected from the group consisting of styrene, p-chlorostyrene and vinylnaphthalene with comonomers selected from the group consisting of ethylene, propylene, 1-butene, isobutene, vinyl chloride, vinyl bromide, vinyl fluoride, vinyl acetate, vinyl propionate, vinyl benzoate, methyl acrylate, ethyl acrylate, n-butyl acrylate, isobutyl acrylate, n-octyl acrylate, dodecyl acrylate, 2-chloroethyl acrylate, phenyl acrylate, methyl α-chloroacrylate, methyl methacrylate, ethyl methacrylate, butyl methacrylate, acrylonitrile, methacrylonitrile, acrylamide, vinyl methyl ether, vinyl ethyl ether, vinyl propyl ether, vinyl isobutyl ether, vinyl methyl ketone, vinyl hexyl ketone, methyl isopropenyl ketone, N-vinylpyrrole, N-vinylcarbazole, N-vinylindole and N-vinylpyrrolidone.

5. The heat-fixable developer according to claim 1, wherein it comprises 1–20 parts by weight of the colorant (B) and 1–20 parts by weight of the releasing agent (C) per 100 parts by weight of the binder resin (A).

6. The heat-fixable developer according to claim 1, wherein the metallocene catalyst (D) comprises a metallocene (E) of a transition metal and at least one of an organic aluminum oxy-compound (F) or an ionizing ionic compound (G).

7. The heat-fixable developer according to claim 6, wherein the metallocene (E) is represented by the formula $$ML_x$$

wherein

M is a metal selected from group IVB of the periodic table, x is the valence of the metal, and L is a ligand coordinating to the metal, wherein at least one ligand has a cyclopentadieneyl skeleton.

8. The heat-fixable developer according to claim 7, wherein the metal is selected from the group consisting of zirconium, titanium and hafnium.

* * * * *